US007260350B2

(12) United States Patent
Hamada et al.

(10) Patent No.: US 7,260,350 B2
(45) Date of Patent: Aug. 21, 2007

(54) IMAGE FORMING APPARATUS

(75) Inventors: Shuta Hamada, deceased, late of Hachioji (JP); by Akira Hamada, legal representative, Hyogo (JP); by Yoshiko Hamada, legal representative, Hyogo (JP); Takenobu Kimura, Hachioji (JP); Yotaro Sato, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 217 days.

(21) Appl. No.: 11/183,445

(22) Filed: Jul. 18, 2005

(65) Prior Publication Data

US 2006/0078359 A1 Apr. 13, 2006

(30) Foreign Application Priority Data

Oct. 8, 2004 (JP) ..... 2004-296006

(51) Int. Cl.

| | |
|---|---|
| ***G03G 15/16*** | (2006.01) |
| ***G03G 15/01*** | (2006.01) |
| ***G03G 15/20*** | (2006.01) |
| ***G03G 15/14*** | (2006.01) |

(52) U.S. Cl. ..... 399/296; 399/311; 399/315; 399/302

(58) Field of Classification Search ..... 399/66, 399/302, 308, 311, 315

See application file for complete search history.

(56) References Cited

FOREIGN PATENT DOCUMENTS

| | | |
|---|---|---|
| JP | 10-274892 | 10/1998 |
| JP | 11-143255 | 5/1999 |

*Primary Examiner*—Hoang Ngo
(74) *Attorney, Agent, or Firm*—Cantor Colburn LLP

(57) ABSTRACT

There is described an image forming apparatus, which makes it possible to conduct a sufficient discharging operation for a toner image. The apparatus includes an image forming section, an image bearing member, an intermediate transfer belt, a part of which is supported in a state of a flat plane by supporting members, a primary transferring device to transfer a toner image from the image bearing member onto the intermediate transfer member, a secondary transferring device to transfer the toner image onto a transfer material, a scorotron discharging device that is disposed at an upstream side of the secondary transferring device, where the part of the intermediate transfer member is supported in the state of the flat plane, and includes a discharging electrode and a grid to discharge the toner image; and a conductive brush that opposes to the scorotron discharging device and contacts the rear surface of intermediate transfer member.

4 Claims, 3 Drawing Sheets

IMAGE FORMING APPARATUS

This application is based on Japanese Patent Application NO. 2004-296006 filed on Oct. 8, 2004 in Japanese Patent Office, the entire content of which is hereby incorporated by reference.

BACKGROUND OF THE INVENTION

The present invention relates to an image forming apparatus, and specifically relates to a color image forming apparatus having an intermediate transfer member onto which a toner image is transferred.

As a color image forming apparatus, which employs an intermediate transfer member, there has been well known such an apparatus in which a toner image formed on an image bearing member is transferred onto an intermediate transfer member, and then, the toner image transferred onto the intermediate transfer member is further transferred onto a transfer material. In the color image forming apparatus of this type, the toner image, formed on the image bearing member and charged at a predetermined polarity, is transferred onto the intermediate transfer member by using an electrostatic force, and then, the toner image residing on the intermediate transfer member is further transferred onto a transfer material by using an electrostatic force.

Specifically, since it is possible for the abovementioned color image forming apparatus to make plural toner images, formed on the image bearing member, overlap with each other on the intermediate transfer member, the apparatus is widely employed as a color image forming apparatus for forming a color image on the transfer material. In the color image forming apparatus of this type, unicolor toner images, each of which is formed on an image bearing member corresponding to each of the primary colors, are sequentially transferred one by one while overlapping with each other on the intermediate transfer member so as to form a full color toner image thereon, and then, the full color toner image is further transferred onto the transfer material at a time by means of a electrostatic force.

Since an amount of electronic charge per one toner particle is substantially uniform, an electronic potential in the toner image residing on the intermediate transfer member is determined by an amount of toner adhered within a predetermined area. Accordingly, in the color image forming apparatus, within the full color toner image formed on the intermediate transfer member, a charged potential of an area at which plural color toners overlap with each other is greater than that of another area at which only a single color toner resides. Further, for instance, when the abovementioned full color toner image formed on the intermediate transfer member includes both a high density area and a halftone area, a charged potential of the high density area is greater than that of the halftone area.

Further, sometimes, variations of the charged potential within the toner image, passed through the primary transferring section for transferring the toner image from the image bearing member to the intermediate transfer member, would occur depending on environmental factors.

The fact that the variations of the charged potential widely vary within the toner image, as mentioned in the above, means that plural areas being different from each other in its transferring characteristics coexist within the same toner image. If it is tried to transfer all of such the plural areas, being different from each other in its transferring characteristics, onto the transfer material under the same transferring conditions, various kinds of image deficiencies are liable to occur at the time of the secondary transferring operation from the intermediate transfer member to the transfer material.

In recent years, colorization trends have been proliferated in the filed of imaging apparatus including a copier, a facsimile, a compound image forming apparatus having such the functions of them, and further, associated with employments of the polymerized toner and small-sized toner particles, demands for high quality imaging have largely increased in the field of transferring process. In addition, speedup trends of the abovementioned image forming apparatus have been progressing as well. In order to produce a good image according to the abovementioned trends, it is necessary to compensate for the electronic potential of the toner image residing on the intermediate transfer member, which varies with a number of the primary transferring operations and the environmental factors, at a substantially a uniform potential, so as to improve the secondary transferring efficiency.

To overcome the abovementioned problem in conventional image forming apparatus, there has been proposed such a configuration that a conductive roller member, serving as a pre-charging device for charging a toner image primary-transferred on the intermediate transfer member before transferring it onto a transfer material, is disposed at a back side of the intermediate transfer member, which is opposed to a charging device and electrodes of the charging device, so as to work as an opposed electrode (for instance, set forth in Patent Document 1). According to this configuration, the charging operation conducted by means of a corona discharging action of AC (Alternate Current), DC (Direct Current), etc., is applied to the toner image transferred onto the intermediate transfer member, so as to make the charge amount over the toner image substantially uniform.

Further, it has been also proposed to provide a controlling apparatus for controlling a charging condition for the pre-charging device, in response to the surface moving velocity of the intermediate transfer member passing through the charging position of the pre-charging device (for instance, set forth in Patent Document 2).

[Patent Document 1]

Tokkaihei 10-274892 (Japanese Non-Examined Patent Publication)

[Patent Document 2]

Tokkaihei 11-143255 (Japanese Non-Examined Patent Publication)

According to the methods described in Patent Documents 1 and 2, since the charge amount of the toner image on the intermediate transfer member is set at a relatively large value as the uniform potential, when the resistivity of the paper, serving as the transfer material, is high due to a low humidity environment or a transferring operation of the second surface of the paper in the duplex copy mode, image deficiencies, due to discharging actions caused by the electronic potential rise of the paper, are liable to occur. If the transferring voltage were set at a low value in order to prevent such the image deficiency, an area, where the total charging amount is relatively large, would be suffered by a lack of transferring electronic field, resulting in an occurrence of the density unevenness.

Further, with respect to the configuration that the conductive roller member, serving as the pre-charging device, is disposed at the back side of the intermediate transfer member, which is opposed to the charging device, so as to work as the opposed electrode, it becomes difficult to acquire a sufficient charging effect according as the line velocity of the intermediate transfer member is getting large in accordance with the speedup trend of the image forming apparatus. In addition, since it is necessary to control the charging condition in response to the line velocity of the intermediate transfer member, the total configuration is getting complicated.

SUMMARY OF THE INVENTION

In the image forming apparatus, which is provided with such a discharging device that makes it possible to conduct a secondary transferring operation well in such a manner that the toner image potential is made to be suppressed for an area of the intermediate transfer member at which the total charge amount of the toner image is relatively large, while the toner image potential is made to be maintained as it is for another area, such as a halftone area, etc., at which a small amount of toner is adhered, so as to acquire a good secondary transferred image without occurring a image roughening and a toner scattering, it is an object of the present invention to provide an image forming apparatus, which makes it possible to conduct a sufficient discharging operation with a simple structure, even if the line velocity of the intermediate transfer member becomes high as a result of speedup measures for its image forming operation, so as to improve the secondary transferring efficiency and to acquire good image.

Accordingly, to overcome the cited shortcomings, the abovementioned object of the present invention can be attained by image forming apparatus described as follow.

(1) An apparatus for forming an image, comprising: an image forming section to form a toner image; an image bearing member to bear the toner image formed by the image forming section; an intermediate transfer member shaped in a belt, a part of which is supported in a state of a flat plane by supporting members; a primary transferring device to transfer the toner image formed on the image bearing member onto the intermediate transfer member; a secondary transferring device to transfer the toner image residing on the intermediate transfer member onto a transfer material; a scorotron discharging device that is disposed at an upstream side of the secondary transferring device in a moving direction of the intermediate transfer member, where the part of the intermediate transfer member is supported in the state of the flat plane, and includes a discharging electrode and a grid to discharge the toner image residing on the intermediate transfer member; and a conductive brush that opposes to the scorotron discharging device and contacts a rear surface of the intermediate transfer member.

(2) The apparatus of item 1, wherein the conductive brush is coupled to a ground.

(3) The apparatus of item 2, wherein the conductive brush is coupled to the ground through a resister.

(4) The apparatus of item 3, wherein a length L1 of the conductive brush in a moving direction of the intermediate transfer member, a length L2 of the grid, included in the scorotron discharging device, in the moving direction of the intermediate transfer member and a gap distance L3 between the grid and a surface of the intermediate transfer member fulfill a relationship of:

$$L1>L2+2\times L3$$

BRIEF DESCRIPTION OF THE DRAWINGS

Other objects and advantages of the present invention will become apparent upon reading the following detailed description and upon reference to the drawings in which.

DETAILED DESCRIPTION OF THE PREFERRED EMBODIMENT

Figure 1:
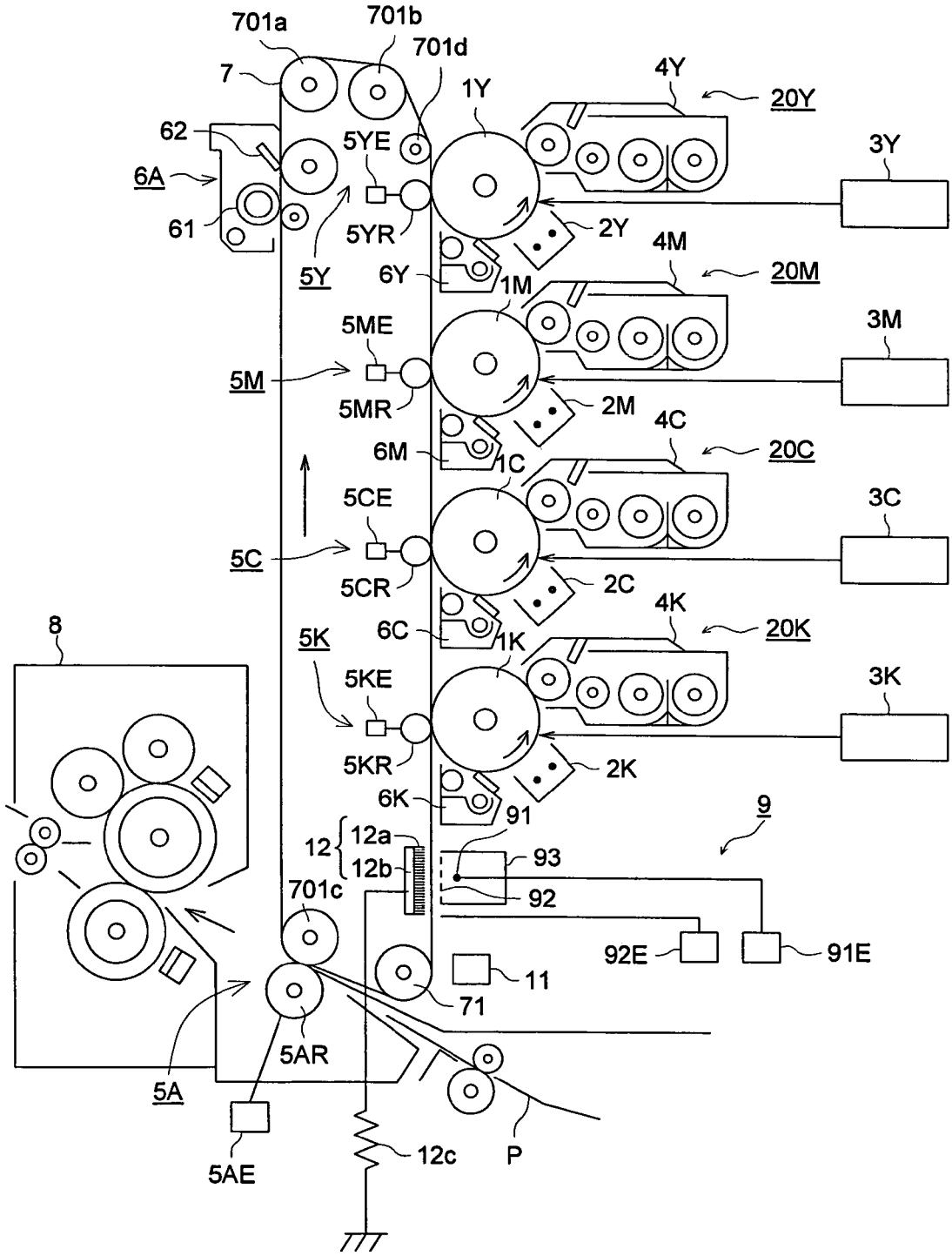
FIG. 1 shows a cross sectional view of a rough configuration of a color image forming apparatus embodied in the present invention.

Referring to the drawings, an embodiment of the present invention will be detailed in the following. The scope of the present invention is not limited to the embodiment described in the following.

FIG. 1 shows a cross sectional view of a rough configuration of a color image forming apparatus embodied in the present invention.

The color image forming apparatus shown in FIG. 1 is generally called as a tandem-type color copier and includes a plurality of image forming sections 20Y, 20M, 20C, 20K, an intermediate transfer unit, a paper feeding device 21 and a fixing device 8.

The image forming section 20Y for forming the unicolor image of color Y (Yellow) includes a charging device 2Y, an exposing section 3Y, a developing device 4Y, a primary transferring device 5Y and a cleaning device 6Y, which are arranged around the photoreceptor drum 1Y serving as an image bearing member. The image forming section 20M for forming the unicolor image of color M (Magenta) includes a charging device 2M, an exposing section 3M, a developing device 4M, a primary transferring device 5M and a cleaning device 6M, which are arranged around the photoreceptor drum 1M serving as an image bearing member. The image forming section 20C for forming the unicolor image of color C (Cyan) includes a charging device 2C, an exposing section 3C, a developing device 4C, a primary transferring device 5C and a cleaning device 6C, which are arranged around the photoreceptor drum 1C serving as an image bearing member. The image forming section 20K for forming the unicolor image of color K (Black) includes a charging device 2K, an exposing section 3K, a developing device 4K, a primary transferring device 5K and a cleaning device 6K, which are arranged around the photoreceptor drum 1K serving as an image bearing member.

The intermediate transfer member 7, having a semi-conductive property and formed in a belt shape, is threaded on a plurality of rollers 701*a*, 701*b*, 701*c*, 701*d*, 71, etc., so as to rotatably move around them. In the present embodiment, the rollers 701*d* and 71 support the intermediate transfer member 7 in such a manner that the section of the intermediate transfer member 7 residing between the rollers 701*d* and 71 is maintained as a straight flat plane. Accordingly, the rollers 701*d* and 71 work as supporting member of the intermediate transfer member 7, in this embodiment.

The image forming section 20Y, including the charging device 2Y, the exposing section 3Y and the developing device 4Y, conducts the charging operation, the exposing operation and the developing operation for the photoreceptor drum 1Y, to form a yellow toner image on the photoreceptor drum 1Y. In the same way, the image forming section 20M, including the charging device 2M, the exposing section 3M and the developing device 4M, forms a magenta toner image on the photoreceptor drum 1M, and the image forming section 20C, including the charging device 2C, the exposing section 3C and the developing device 4C, forms a cyan toner image on the photoreceptor drum 1C, and the image forming section 20K, including the charging device 2K, the exposing section 3K and the developing device 4K, forms a cyan toner image on the photoreceptor drum 1K. The unicolor toner images formed on the photoreceptor drums 1Y, 1M, 1C, 1K are sequentially transferred onto the intermediate transfer member 7 by the primary transferring devices 5Y, 5M, 5C, 5K while overlapping with each other so as to form a multicolor toner image (hereinafter, also referred to as a full color toner image).

Although a well known material, such as an organic photosensitive material, an a-Silicon photosensitive material, etc., can be employed as the photoreceptor drum 1Y, the organic photosensitive material would be preferable, and specifically, it is preferable that the organic photosensitive material has a negative charging property. In the present embodiment, the organic photosensitive material having the negative charging property is employed.

Although a corona discharging device, such as a scorotron, a corotron, etc., is employed for each of charging devices 2Y, 2M, 2C, 2K, the scorotron discharging device is preferably employed.

A light emitting element, such as a laser, a LED array, etc., which emits light modulated according to image data, is employed for each of the exposing sections 3Y, 3M, 3C, 3K.

Although either a developing device, which employs two-component developer containing carrier and toner as main gradients, or another developing device, which employs single-component developer containing only toner as a main gradient without containing carrier, can be employed as each of the developing devices 4Y, 4M, 4C, 4K, it is preferable to employ the developing device, which employs the two-component developer. Further, although either a normal developing method or a reverse developing method can be employed for the developing device, it is preferable to employ the reverse developing method in which toner, charged at a polarity same as that of the charged photoreceptor drum by applying a developing bias having a polarity same as that of the photoreceptor drum to a developing sleeve 4*a*, are used for the developing operation. In the present embodiment, the reverse developing method using the negative charged toner is employed for the developing operation.

To maintain a high image quality and to prevent an occurrence of fogging, it is preferable that a volume average particle diameter of toner to be employed is in a range of 3-6 μm.

The value of the volume average particle diameter, being the average particle diameter referring to the volume, is measured by the "Coulter counter TA-II" (manufactured by Coulter Co. LTD.), which is provided with a wet dispersion apparatus.

By employing the abovementioned toner, it becomes possible to form a high quality image with a high-resolution capability.

Further, in the present invention, it is preferable to employ spherical-shaped toner having a spherical degree in a range of 0.94-0.98, so as to hardly receive strong stresses in the developing device, so as to hardly cause the fogging and the scattering of the toner, and so as to maintain the cleaning efficiency at a high level.

The spherical degree can be calculated by employing the following equation.

$$SD=CLC/PCL$$

where SD: spherical degree,

CLC: circumferential length of the circle having an area same as that of the projected particle image, PCL: circumferential length of the projected particle image.

To calculate the spherical degree, initially, photographic images enlarged up to 500 times of the original size with respect to 500 resin particles are captured by the scanning-type electron microscope or the laser microscope, and then, the spherical degrees of them are measured by analyzing the photographic images by means of a "SCANNING IMAGE ANALYZER" (manufactured by Japan Electron Co. LTD.), and finally, the arithmetical mean of them is calculated as the spherical degree of the toner concerned. Alternatively, as a simplified method for measuring the spherical degree, a flow-type particle image analyzer ("FPIA-1000", manufactured by Toa Iyou Denshi K.K.) can be applicable for this purpose.

It is desirable that polymerization toner are used for such the toner having the small-sized particles and the high spherical degree.

The polymerization toner are such toner that is acquired by forming the binder resin included in the toner and the shape of each toner particle through the polymerization process of raw material monomer or pre-polymer and successive chemical processing. Concretely speaking, the polymerization toner are acquired through a polymerizing reaction process, such as a suspension polymerization, an emulsification polymerization, etc., and through an adhesion process between particles to be successively conducted after the polymerizing reaction process as needed. Since the polymerization toner are manufactured by polymerizing the raw material monomer or pre-polymer after uniformly dispersing it in a certain water system, it is possible to produce the toner having a uniform distribution of the toner granularity and a uniform particle shape.

Concretely speaking, the polymerization toner can be manufactured by the method including the steps of manufacturing material created according to the suspension polymerization method, or manufacturing polymerized particles as fine particles by emulsion-polymerizing monomer in the liquid of water medium added with emulsifying liquid, and then, associating them by adding organic solvent, flocculating agent, etc. Further, a preparation method of mixing fluid dispersion, such as parting agent, coloring agent, etc., which is necessary as a component of the toner, when associating them, a method of emulsion-polymerizing the component of the toner, such as the parting agent, the coloring agent, etc., after dispersing them, etc. can be cited. Hereinafter, the term of the "associating" is to fuse plural resin particles and plural coloring particles with each other.

Numeral 5A indicates a secondary transferring device, which includes a transfer roller 5AR, having a conductive rubber roller, and a power source 5AE.

Numeral 6A indicates an intermediate-transfer member cleaning device for cleaning intermediate transfer member 7, while numeral 8 indicates a fixing device for fixing a toner image onto the transfer material P.

The intermediate transfer member 7 is either a single layer belt or a multi layer belt made of polyamide, polyimide, etc.

The volume resistivity of intermediate transfer member 7 is a value in a range of $10^7$-$10^{12}$ Ω·cm. In the present embodiment, the volume resistivity is set at $10^9$ Ω·cm.

On the other hand, after the secondary transferring operation for the transfer material P, conducted by the transfer roller 5AR, is completed, the intermediate transfer member 7 passes through a cleaning point. At this cleaning point, the intermediate-transfer member cleaning device 6A cleans the surface of the intermediate transfer member 7.

Figure 2:
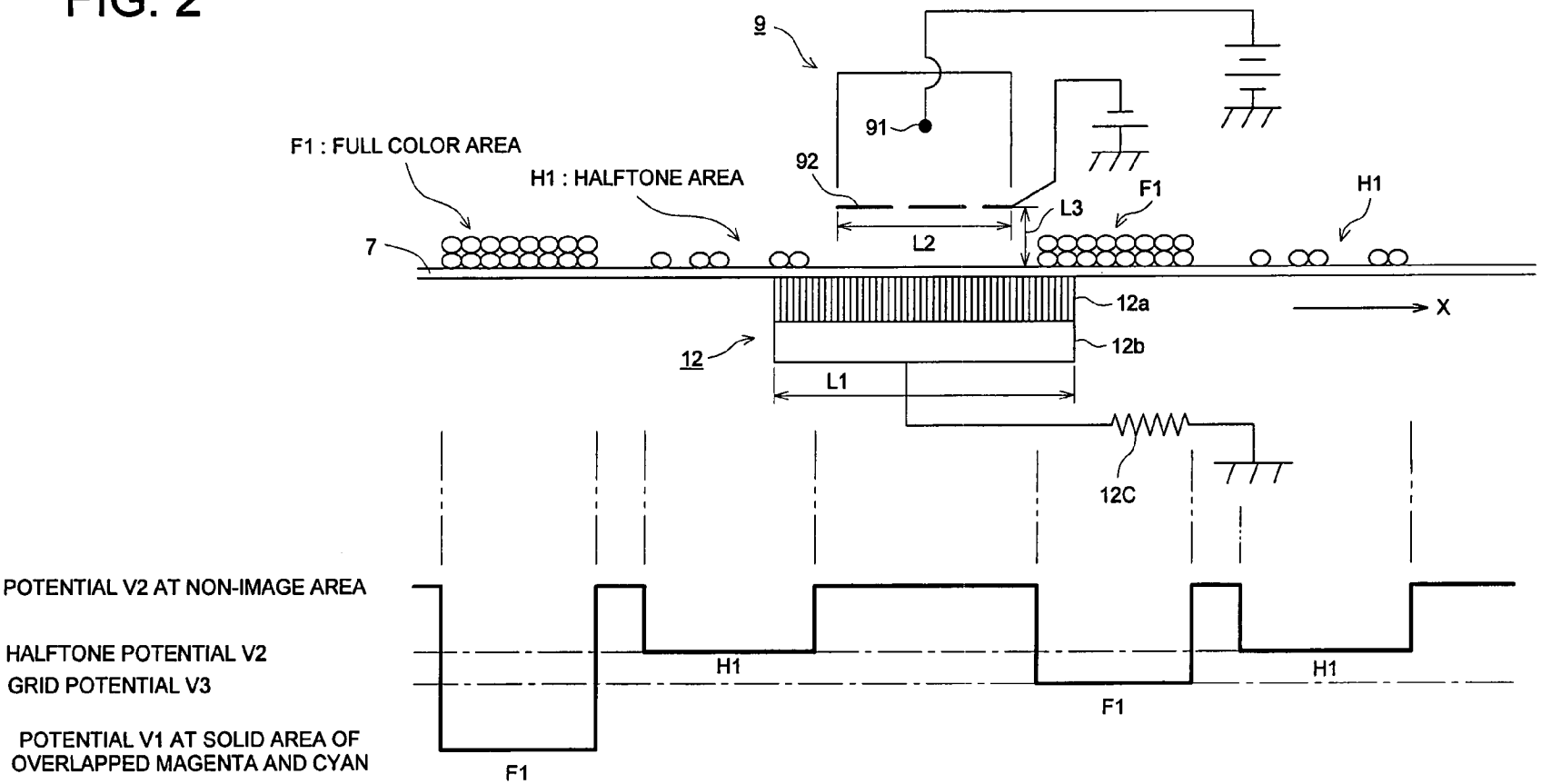
FIG. 2 shows a cross sectional schematic diagram of a rough configuration of a scorotron discharging device and a conductive brush, and a chart indicating electric potential changes of a toner image before and after passing through a scorotron discharging device.

In the present embodiment, a scorotron discharging device 9, serving as a pre-discharging device, is disposed at such a position at which the intermediate transfer member is supported in a state of the straight flat plane between the primary transferring device 5K and the secondary transferring device 5A along the intermediate transfer member 7. Referring to FIG. 2, the scorotron discharging device 9 will be detailed in the following.

FIG. 2 shows a cross sectional schematic diagram of a configuration of the scorotron discharging device 9 shown in FIG. 1. The scorotron discharging device 9 is constituted by a discharging electrode 91, a grid 92 and a side plate 93. The grid 92 is disposed at a position opposite to the belt surface of the intermediate transfer member 7 with a gap L3 between them. The side plate 93 is coupled to an electronic circuit (not shown in the drawings) so as to maintain its electronic potential same as that of the grid 92.

A wired grid, a plate-shaped grid having a pattern formed by etching a metal plate, etc., can be employed as the grid 92. In the present embodiment, a plate-shaped grid, onto which gold plating is applied, is employed as the grid 92. Further, the width of the grid 92 is set at L2 in the moving direction of the intermediate transfer member 7 (indicated by arrow X in FIG. 2).

Although a wire material, such as a tungsten wire, a stainless wire, a gold wire, etc., whose diameter is in a range of 20-150 μm, can be employed for the discharging electrode 91, it is specifically preferable that the surface of the discharging electrode 91 is finished with a gold coating. It is applicable that the gold wire itself is employed as the discharging electrode, or the gold coating is applied onto the stainless wire, the tungsten wire, etc. for finishing the discharging electrode. It is desirable that the thickness of the gold coating is set at a value in a range of 1-5 μm as an average coating thickness, from view points of an efficiency for removing discharging products, such as ozone, etc., a manufacturing cost and a discharging efficiency.

A opposing electrode 12, constituted by a conductive brush 12*a* and a supporting member 12*b* for supporting the conductive brush 12*a*, is disposed at a back side of the intermediate transfer member 7 opposing to the scorotron discharging device 9 thereat. The conductive brush 12*a* contacts the back side of the intermediate transfer member 7, and the opposing electrode 12 is coupled to the ground through resister 12*c*.

The conductive brush 12*a* is made of conductive resin fibers, such as acrylic, nylon, polyester, etc. It is preferable that each diameter of the conductive resin fibers is in a range of 0.111-0.778 tex in the metric unit of yarn number proposed by ISO, and a fiber density of the conductive brush 12*a* is in a range of 12000-77000 fibers/$cm^2$, and a resistivity of each fiber is in a range of 1-$10^5$ Ω·cm. Further, the width of the conductive brush 12*a* is set at width L1 in the moving direction of the intermediate transfer member 7 (indicated by arrow X shown in FIG. 2).

The present embodiment is so constituted that a DC voltage in a range of 0-5 kV having a polarity inverse to that of the toner can be applied to the discharging electrode 91, while a voltage in a range of 0--300 V can be applied to the grid 92.

In the present embodiment, a DC voltage of +4 kV is applied to the discharging electrode 91 of the scorotron discharging device 9, a voltage of −50 V is applied to the grid 92, length L1 of the grid 92 is set at 40 mm, gap L3 between the scorotron discharging device 9 and the intermediate transfer member 7 is set at 1 mm, and width L1 of the conductive brush 12*a* is set at 45 mm.

Referring to FIG. 2, the performance of the scorotron discharging device 9 will be detailed in the following.

FIG. 2 is a schematic diagram indicating an electric potential change of the toner layer residing on intermediate transfer member 7 before and after the toner image passes through the scorotron discharging device 9 to which the bias voltage is applied. Incidentally, the structural element same as that indicated in FIG. 1 is denoted by the same reference number, and explanations for them will be omitted.

An electric potential V1 of a full color area F1, at which an amount of adhered toner is relatively large and the electric potential is relatively high, is reduced to electric potential V3 after the full color area F1 has passed through the scorotron discharging device 9. On the other hand, an electric potential V2 of a halftone area H1, at which an amount of adhered toner is relatively small and the electric potential is relatively low, is substantially maintained as it is even after the halftone area H1 has passed through the scorotron discharging device 9.

To concretely describe the present invention, various embodiments will be detailed in the following. However, the scope of the present invention is not limited to the following embodiments.

Embodiment 1

In the embodiment 1, the color image forming apparatus, in which the scorotron discharging device 9 and the opposing electrode 12 are disposed in the manner shown in FIG. 1 and FIG. 2, is employed for forming an image.

The main specifications of the color image forming apparatus shown in FIG. 1 are indicated as follow.

1) intermediate transfer member 7: made of polyimide belt (volume resistivity $10^9$ Ω·cm), line velocity; 220 mm/sec.
2) scorotron discharging device 9: length L2 of grid 92; 40 mm, gap L3 between the scorotron discharging device 9 and the intermediate transfer member; 1 mm, DC voltage applied to the discharging electrode 91; +4 kV, voltage applied to the grid 92; −50 V.
3) opposing electrode 12: made of acrylic fibers (manufactured by Tokyo rayon Co. Ltd., resistivity of original fiber; $10^2$ Ω·cm, diameter of the fiber; 0.33 tex, length of the fiber; 3 mm), width L1; 45 mm, fiber density; 31000 fibers/$cm^2$, coupled to the ground through register 12*c* of 1 MΩ.
4) toner: polymerization toner, volume-average particle diameter; 4.5 μm, spherical degree; 0.96.
5) charging devices 2Y, 2M, 2C, 2K: charging voltage; −700 V (as a standard value, variable).
6) exposing sections 3Y, 3M, 3C, 3K: semiconductor laser (wavelength; 780 nm), surface potential Vi of the photoreceptor drum 1Y; −50 V.
7) developing devices 4Y, 4M, 4C, 4K: electric potential Vdc of developing sleeve 4*a;* −500 V (as a standard value, variable), AC component of the developing bias voltage; 1 kVp-p rectangular wave (frequency; 5 kHz).

Embodiment 2

The image is formed under the conditions same as those of embodiment 1, except that width L1 of conductive brush 12*a* of the opposing electrode 12 is changed to 60 mm.

Embodiment 3

The image is formed under the conditions same as those of embodiment 1, except that width L1 of conductive brush 12*a* of the opposing electrode 12 is changed to 30 mm.

COMPARISON EXAMPLE 1

Figure 3:
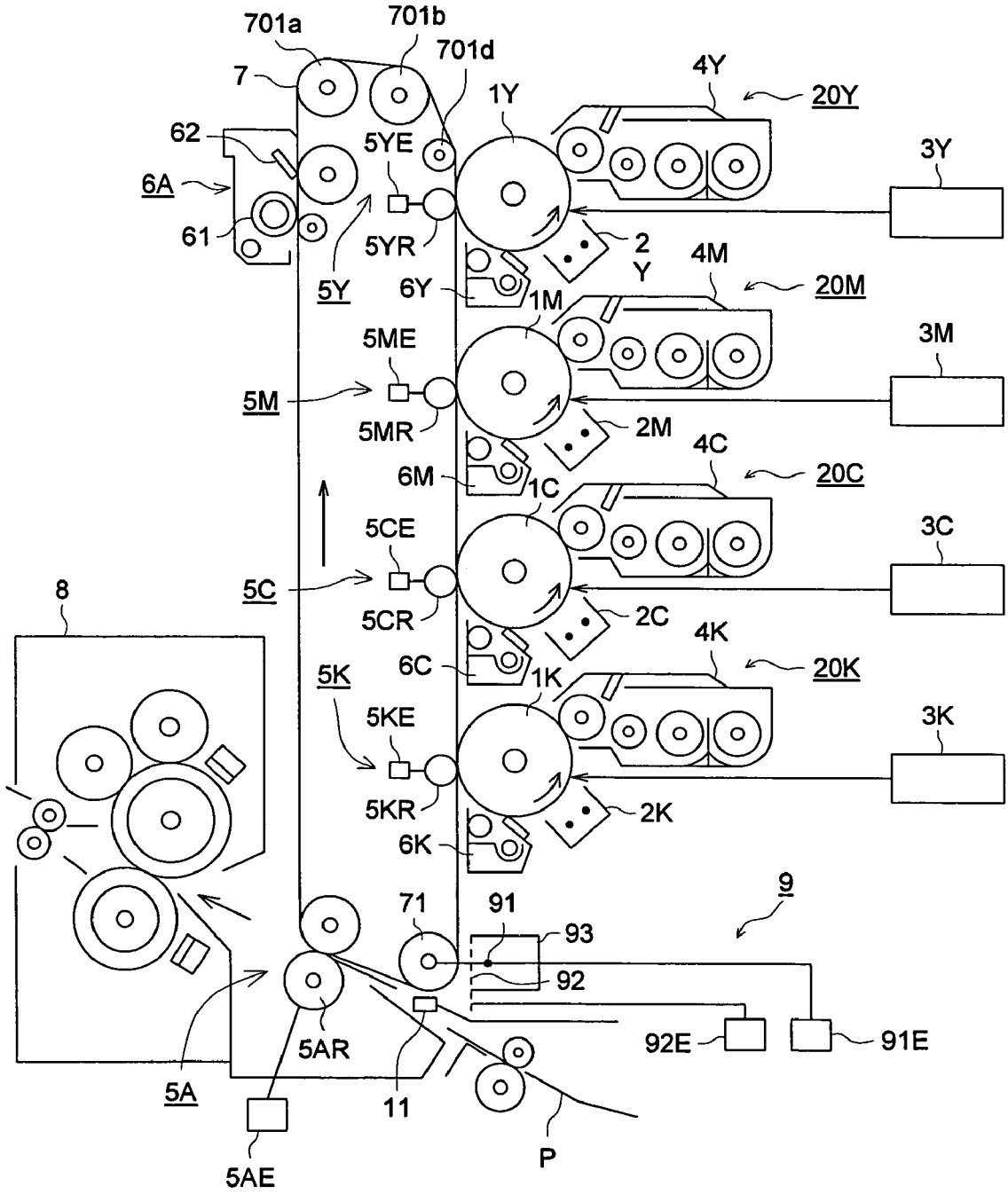
FIG. 3 shows a cross sectional view of a rough configuration of a color image forming apparatus employed for comparison examples 1 and 2.

In the comparison example 1, instead of the color image forming apparatus employed in the embodiment 1 and shown in FIG. 1, a color image forming apparatus shown in FIG. 3 is employed for forming an image.

Instead of the opposing electrode 12 including the conductive brush 12*a* which is employed in the color image forming apparatus shown in FIG. 1, the color image forming apparatus shown in FIG. 3 is so constituted that the roller 71, on which the intermediate transfer member 7 is threaded, is also work as an opposing electrode. In order to achieve such the configuration, the opposing electrode 12 including the conductive brush 12*a* employed in the color image forming apparatus shown in FIG. 1 is removed, and the scorotron discharging device 9 is shifted to such a position that it opposes the roller 71, now working as the opposing electrode, while putting the intermediate transfer member 7 between them, and further, associated with such the changes, a surface electric potentiometer 11 is also moved to a position shown in FIG. 3.

The overall structures, other than the configuration changed in the above, are common as those of the color image forming apparatus shown in FIG. 1.

COMPARISON EXAMPLE 2

The image is formed under the conditions same as those of comparison example 1, except that the length of the grid is changed to 20 mm.

COMPARISON EXAMPLE 3

In the color image forming apparatus shown in FIG. 1 as the embodiment 1, the image is formed under a condition that no voltages are applied to the discharging electrode 91 and the grid 92, namely, without discharging the toner image.

Evaluation Method and Evaluation Reference

High-density duplex images, each of which was formed by mixing color M (Magenta) and color C (Cyan) with each other under a low temperature and low humidity environment (10° C., 20% (ReH)), were outputted, and the transferring unevenness of the reverse sides were evaluated on the basis of visual observation of a viewer, so as to categorize them into the following ranks.

(Ranks of Unevenness)

Good: no transferring unevenness was recognized, or little unevenness was recognized.

Passable: a little transferring unevenness was recognized, but practically no problem.

Bad: transferring unevenness was clearly recognized to an extent that it would become a practical problem.

TABLE 1

| | DISCHARGING ELECTRODE | WIDTH OF ELECTRODE | LINE VELOCITY | OPPOSING ELECTRODE | RREVERSE SIDE IMAGE | POTENTIAL OF TONER LAYER AFTER DISCHARGING |
|---|---|---|---|---|---|---|
| EMBODIMENT 1 | DISCHARGING ELECTRODE 1 | 40 mm | 220 mm/sec | BRUSH(WIDTH: 45 mm) | Good | −70 V |
| EMBODIMENT 2 | DISCHARGING ELECTRODE 1 | 40 mm | 220 mm/sec | BRUSH(WIDTH: 45 mm) | Good | −70 V |
| EMBODIMENT 3 | DISCHARGING ELECTRODE 1 | 40 mm | 220 mm/sec | BRUSH(WIDTH: 45 mm) | Passable | −100 V |
| COMPARISON EXAMPLE 1 | DISCHARGING ELECTRODE 1 | 40 mm | 220 mm/sec | ROLLER(DIA.: 30 mm) | Bad | −120 V |
| COMPARISON EXAMPLE 2 | DISCHARGING ELECTRODE 2 | 20 mm | 220 mm/sec | ROLLER(DIA.: 30 mm) | Bad | −130 V |
| COMPARISON EXAMPLE 3 | WITHOUT ELECTRODE | | 220 mm/sec | | Bad | −170 V |

As shown in Table 1, in the embodiment 1 and the embodiment 2, by disposing the discharging device at such the position that the intermediate transfer member is supported in a state of the straight flat plane, by employing the conductive brush as the opposing electrode, by contacting the conductive brush onto the intermediate transfer member, and by making length L1 of the conductive brush 12*a* fulfill the condition of L1>L2+2×L3, the effect of discharging the toner image was secured even when the line velocity of intermediate transfer belt was relatively high, resulting in an acquisition of the good image.

In the embodiment 3, since length L1 of the conductive brush 12*a* was shorter than that of the discharging electrode without fulfilling the condition of L1>L2+2×L3, a little transferring unevenness was generated. However, the effect of discharging the toner image, which would cause practically no problem, could be achieved.

In the comparison example 1 and the comparison example 2, since the opposing electrode was the roller 71 having a curvature, it was impossible to maintain the gap between the grid 92 and the intermediate transfer member 7 within a certain range. Accordingly, it was impossible to acquire the effect of sufficient discharging the toner image, and therefore, the transferring unevenness was generated on the acquired image to an extent that it would become a practical problem.

According to the present invention, the following effects can be attained.

(1) By disposing the scorotron discharging device at such a position that the intermediate transfer member is supported in a state of a flat plane, it becomes possible to widen the effective width of the scorotron discharging device while maintaining the gap distance between the grid included in the scorotron discharging device and the intermediate transfer member at a value within a certain range, resulting in an appropriate controlling operation for the toner charge. Further, by disposing the conductive brush, serving as an opposing electrode, at the rear side of the intermediate transfer member so as to contact the rear surface of the intermediate transfer member, it is possible to achieve a sufficient discharging effect for the toner image without applying a load to the intermediate transfer member.

(2) Still further, it becomes possible to simplify the structure of opposing electrodes in the scorotron discharging device, resulting in a reduction of variance factors in the discharging device and an improvement of its maintenance performance.

(3) Still further, it becomes possible to adjust the electric potential between the opposing electrodes in the scorotron discharging device, and therefore, it becomes possible to absorb variance factors of the opposing electrodes and the intermediate transfer member, such as individual differences between conductive brushes, a contacting pressure and a contacting resistance between the conductive brush and the intermediate transfer member, etc., resulting in an improvement of a stability of the discharging operation.

(4) Still further, by making the length of the conductive brush in the moving direction of the intermediate transfer member sufficiently longer than that of the grid of the scorotron discharging device, all of the effective area of the scorotron discharging device becomes usable, resulting in an improvement of the discharging efficiency.

What is claimed is:

1. An apparatus for forming an image, comprising:

an image forming section to form a toner image;

an image bearing member to bear said toner image formed by said image forming section;

an intermediate transfer member shaped in a belt, a part of which is supported in a state of a flat plane by supporting members;

a primary transferring device to transfer said toner image formed on said image bearing member onto said intermediate transfer member;

a secondary transferring device to transfer said toner image residing on said intermediate transfer member onto a transfer material;

a scorotron discharging device that is disposed at an upstream side of said secondary transferring device in a moving direction of said intermediate transfer member, where said part of said intermediate transfer member is supported in said state of said flat plane, and includes a discharging electrode and a grid to discharge said toner image residing on said intermediate transfer member; and a conductive brush that opposes to said scorotron discharging device and contacts a rear surface of said intermediate transfer member.

2. The apparatus of claim 1, wherein said conductive brush is coupled to a ground.

3. The apparatus of claim 2, wherein said conductive brush is coupled to said ground through a resistor.

4. The apparatus of claim 3, wherein a length L1 of said conductive brush in a moving direction of said intermediate transfer member, a length L2 of said grid, included in said scorotron discharging device, in said moving direction of said intermediate transfer member and a gap distance L3 between said grid and a surface of said intermediate transfer member fulfill a relationship of $$L1>L2+2\times L3.$$

* * * * *